US005974702A

United States Patent [19]

Donoghue

[11] Patent Number: 5,974,702

[45] Date of Patent: Nov. 2, 1999

[54] SNOW PLOW MOUNTING ASSEMBLY

[76] Inventor: John Barry Donoghue, P.O. Box 55, Wisimsbury, Conn. 06092

[21] Appl. No.: 09/088,115

[22] Filed: Jun. 1, 1998

[51] Int. Cl.[6] ..... E01H 5/04

[52] U.S. Cl. ..... 37/263; 37/231; 37/234; 37/266; 172/819

[58] Field of Search ..... 37/231–232, 233, 37/234–235, 236, 263, 266; 172/811, 815, 816, 817, 818, 819

[56] References Cited

U.S. PATENT DOCUMENTS

| | | | |
|---|---|---|---|
| 1,543,222 | 6/1925 | Lutz | 37/232 |
| 3,545,109 | 12/1970 | Boschung | 37/233 |
| 3,772,803 | 11/1973 | Cote | 37/233 |
| 4,008,771 | 2/1977 | Tomio | 37/236 |
| 4,153,117 | 5/1979 | Freese | 172/816 |
| 4,439,939 | 4/1984 | Blau . | |
| 4,554,978 | 11/1985 | Schneider | 172/817 |
| 4,570,366 | 2/1986 | Yost | 37/232 |
| 4,680,880 | 7/1987 | Boneta | 172/819 |
| 4,754,562 | 7/1988 | McGarrah et al. | 172/817 |
| 4,778,195 | 10/1988 | Vachon | 172/817 |
| 4,976,054 | 12/1990 | Jones | 37/235 |
| 5,018,284 | 5/1991 | Mikami et al. . | |
| 5,140,763 | 8/1992 | Nichols, IV | 37/233 |
| 5,193,296 | 3/1993 | Reilley . | |
| 5,285,588 | 2/1994 | Niemela et al. | 37/234 |
| 5,435,032 | 7/1995 | Frenette et al. | 37/236 |
| 5,595,007 | 1/1997 | Biance | 37/232 |
| 5,638,618 | 6/1997 | Niemela et al. . | |
| 5,819,444 | 10/1998 | Desmarais | 37/234 |

*Primary Examiner*—Thomas B. Will
*Assistant Examiner*—Kristine M. Markovich
*Attorney, Agent, or Firm*—Bachman & LaPointe, P.C.

[57] ABSTRACT

The present invention relates to an assembly for mounting a plow, such as a snow plow, to a vehicle. The assembly has a linear support member extending from and attached to the front of the vehicle. The linear support member is pivotable with respect to the central longitudinal axis of the vehicle and has the plow attached to it at its remote end. The assembly further includes devices connected to the linear support member for offsetting the plow from the central longitudinal axis of the vehicle so that the plow is positioned in front of the tire path of and ahead of the direction of travel of the vehicle. The offsetting devices preferably comprise two pairs of piston-cylinder units. A first pair is mounted at one end to the front of the vehicle and at a second end to the linear support member. The second pair is connected at one end to the plow and at a second end to the linear support member. The assembly further includes a control device for positioning the plow at a desired angular orientation with respect to the central longitudinal axis of the vehicle.

14 Claims, 5 Drawing Sheets

SNOW PLOW MOUNTING ASSEMBLY

BACKGROUND OF THE INVENTION

The present invention relates to a snow plow assembly suitable for use with a wheeled vehicle such as a truck or an automobile.

Many different types of snow plows are known in the prior art. Conventional plows include a blade and a frame for coupling the blade to the front of the vehicle. More sophisticated plows also include means for adjusting the angular orientation of the plow blade relative to the longitudinal axis of the vehicle for elevating the plow blade relative to the road surface to permit the vehicle to be driven from one location to another.

More sophisticated plows also include means for adjusting the angular orientation of the plow blade relative to the longitudinal axis of the vehicle so as to push the snow left or right as the vehicle traverses the surface being cleared of snow. U.S. Pat. Nos. 4,439,939 to Blau; 5,018,284 to Mikami; 5,193,296 to Reilley; and 5,638,618 to Niemela et al. are illustrative of the various types of snow plows known in the prior art.

One of the deficiencies of prior art snow plows is that when turning, the paths of the snow plow and the tires are different. FIGS. 1 and 2 illustrate a vehicle 10 have a prior art arrangement for mounting a snow plow 12 to the front of the vehicle. The mounting arrangement includes a V-shaped support member 16 mounted to the front of the vehicle and pivotally mounted to the rear of the snow plow 12. The arrangement further includes two piston-cylinder units 18 and 20, each pivotally mounted to and extending between the snow plow 12 and the V-shaped member 16. As can be seen in FIG. 1, the tires 14 do not follow the plow path when turning. As a result, the snow is not effectively cleared from both the surface and the front of the vehicle. Yet another problem with the prior art designs is that the snow plows have a limited range of motion with respect to the center line of the vehicle.

It is the aim of the present invention to overcome these deficiencies.

SUMMARY OF THE INVENTION

Accordingly, it is an object of the present invention to provide an improved assembly for mounting a plow to a vehicle.

It is a further object of the present invention to provide a mounting assembly which increases the range of motion of the plow relative to the central longitudinal axis of the vehicle.

It is another object of the present invention to provide a mounting assembly as above which allows the plow and the tires of the vehicle to move along the same path.

The foregoing objects are attained by the snow plow assembly of the present invention.

In accordance with an embodiment of the present invention, the snow plow assembly has a linear support member extending from and attached to the front of the vehicle. The linear support member is pivotable with respect to the central longitudinal axis of the vehicle and has a snow plow blade attached to it at its remote end. The assembly further includes means connected to the linear support member for offsetting the plow from the central longitudinal axis of the vehicle so that the snow plow is positioned in front of the tire path of the vehicle. The offsetting means is formed by two pairs of piston-cylinder units. A first pair is mounted at one end to the front of the vehicle and at a second end to the linear support member. The second pair is connected at one end to the snow plow and at a second end to the linear support member. The assembly further includes an operating means for positioning the snow plow at a desired angular orientation with respect to the central longitudinal axis of the vehicle.

Other details of the snow plow assembly of the present invention, as well as other objects and advantages attendant thereto, are set forth in the following description and the accompanying drawings wherein like reference numerals depict like elements.

DETAILED DESCRIPTION OF THE PREFERRED EMBODIMENT(S)

Figure 1:
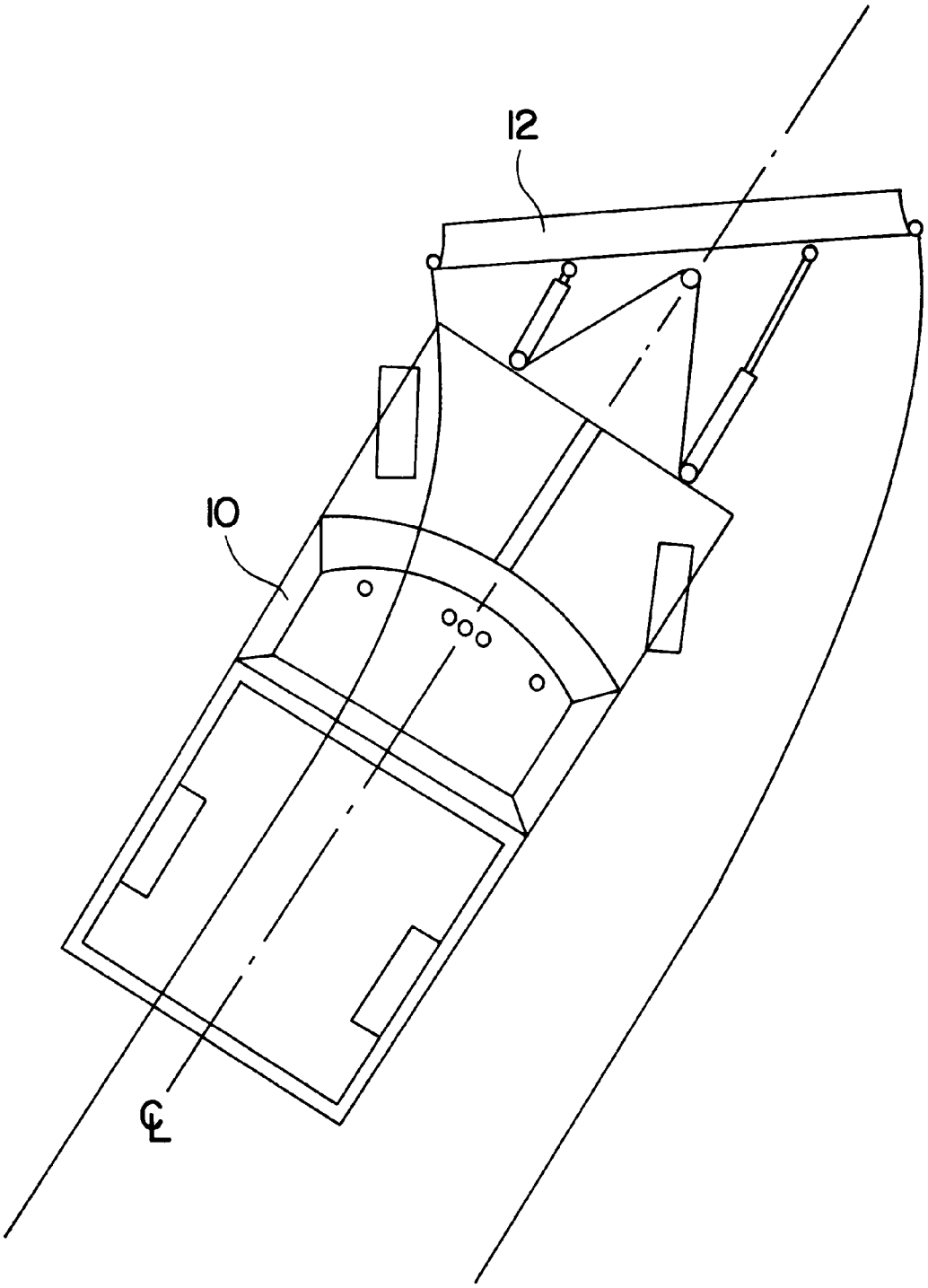
FIG. 1 PRIOR ART
FIG. 1 is a top view of a vehicle having a prior art snow plow assembly.
Figure 2:
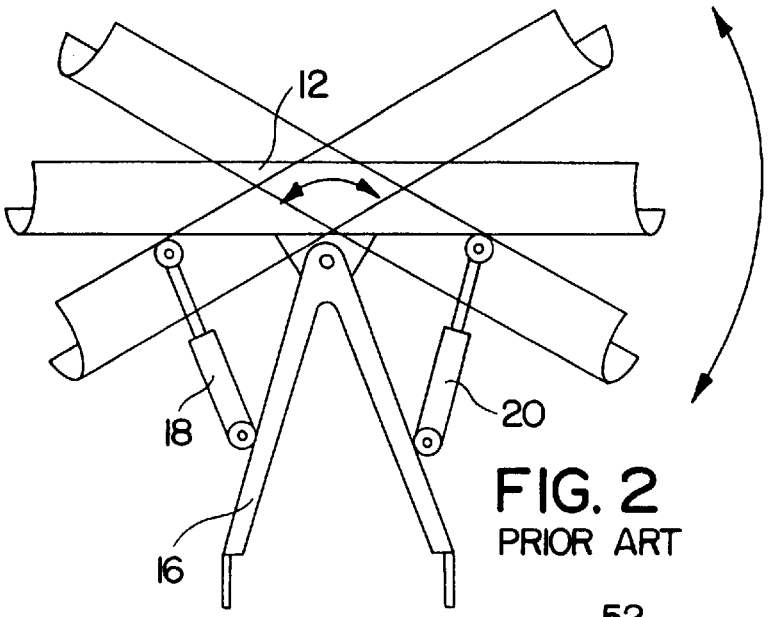
FIG. 2 PRIOR ART
FIG. 2 is a top view of the prior art assembly for mounting the snow plow to the vehicle of FIG. 1.
Figure 3:
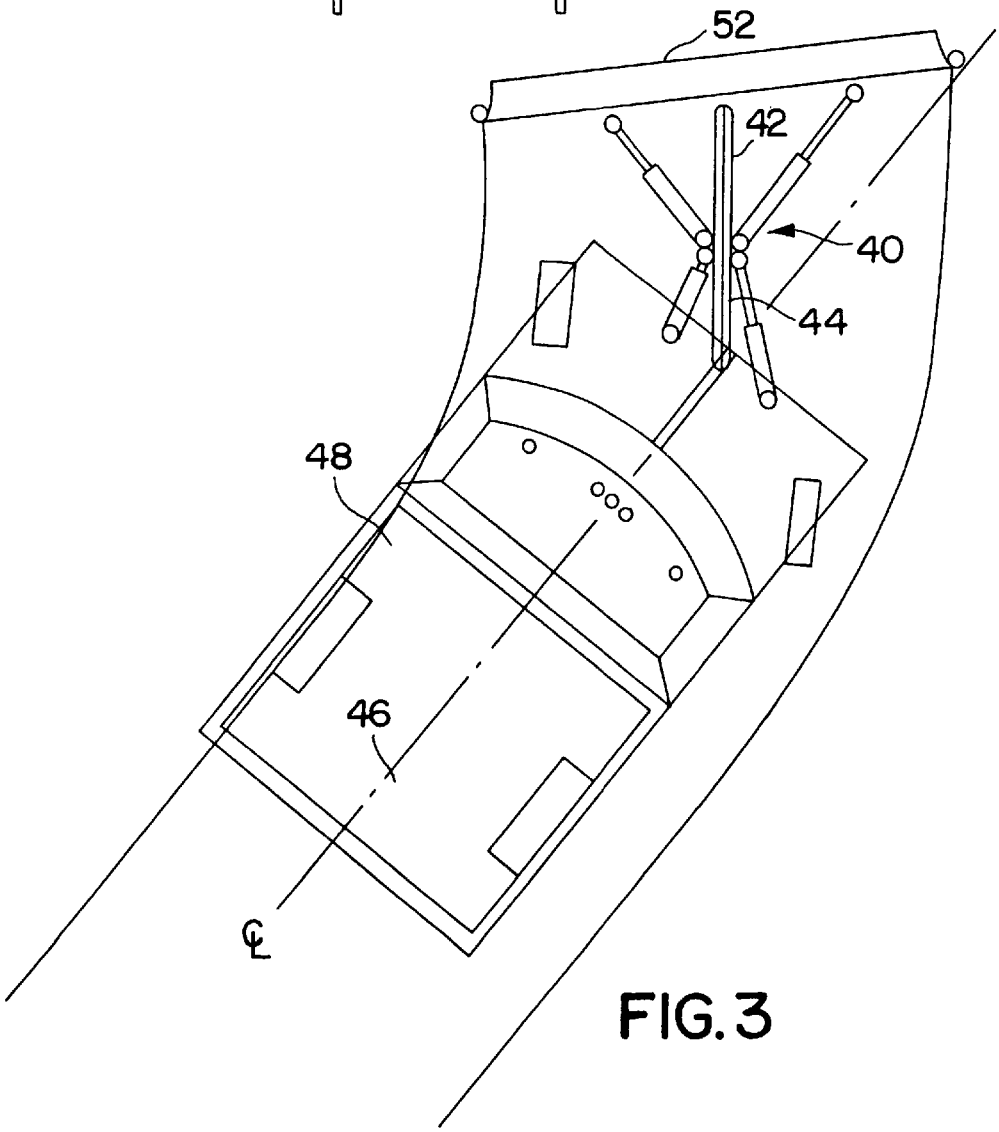
FIG. 3 is a top view of a vehicle with the snow plow assembly of the present invention.
Figure 4:
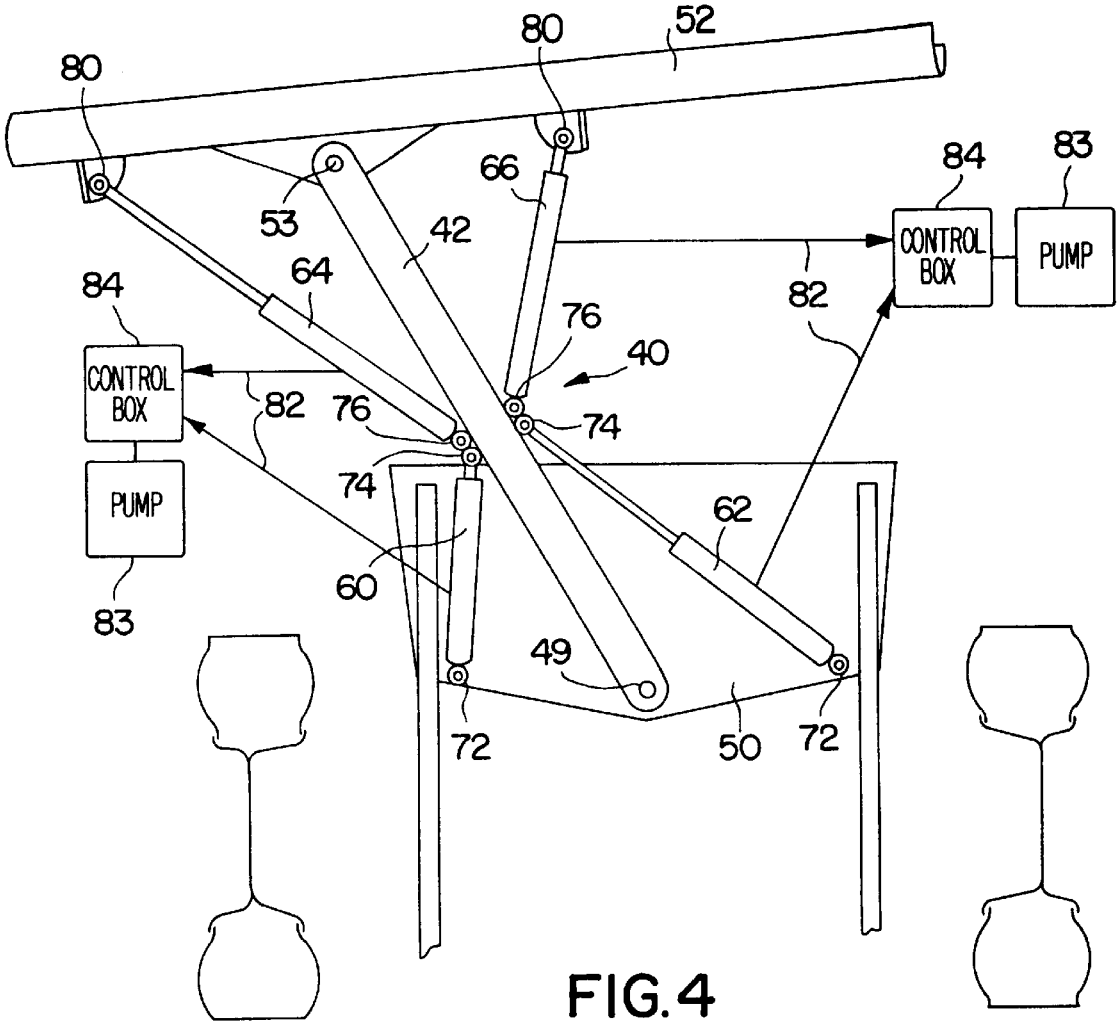
FIG. 4 is an enlarged top view of the snow plow assembly of the present invention.
Figure 6:
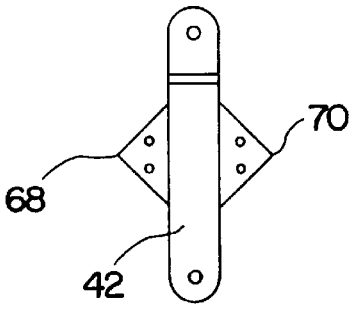
FIG. 6 is a top view of the linear support member used in the snow plow assembly of the present invention.

Referring now to the drawings, FIGS. 3 through 6 illustrate the inventive snow plow assembly 40 of the present invention. As best seen in FIG. 4, the snow plow assembly 40 includes a linear support member or central boom 42 for allowing a snow plow blade 52 to shift left or right off the central longitudinal axis 46 of the vehicle so that when plowing around a corner or curved surface, the plow can be positioned ahead of the direction of travel and thereby prevent the inside tires from travelling outside of the plow path. The support member or central boom 42, in a base position, has its longitudinal axis 44 aligned with the central longitudinal axis 46 of the vehicle 48. The linear support member or central boom 42 is hinged to the front end 50 of the vehicle 48 by a hinge 49. At its opposite end, the linear support member 42 is hingedly connected to the snow plow blade 52 by a connection 53 such as a threaded pin connection.

Figure 5:
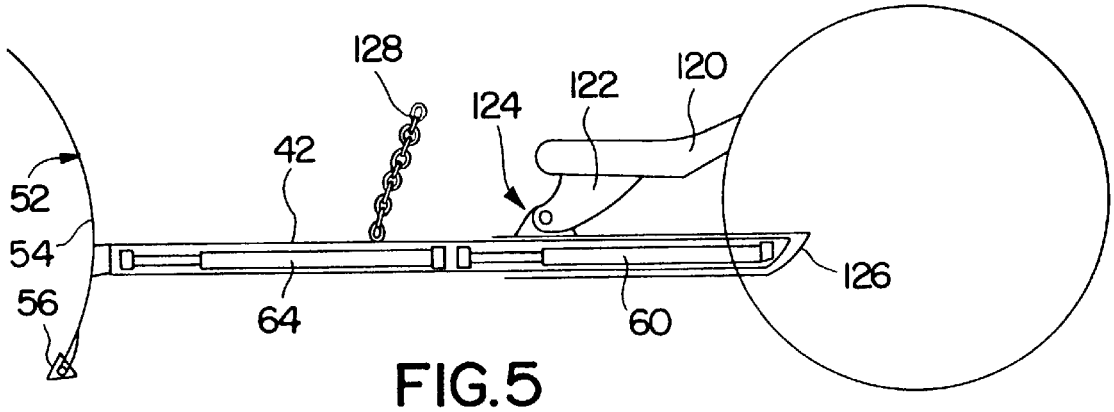
FIG. 5 is a side view of the snow plow assembly of FIG. 4.
Figure 8:
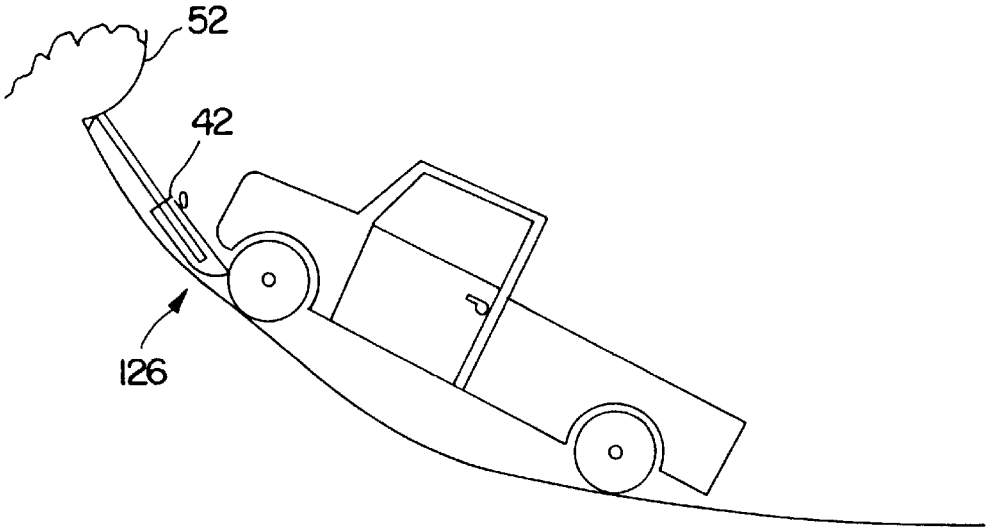
FIG. 8 is a view of a vehicle having a snow plow assembly in accordance with the present invention.

As best shown in FIG. 5, the linear support member 42 is mounted to the front of the vehicle by a frame member 120 having a downwardly extending arm 122. The linear support member is connected to the frame member 120 by an up/down hinge 124. The hinge 124 may comprise any suitable up/down hinge known in the art. The linear support member preferably has a rear portion 126 having a bow-like shape. This uniquely designed rear portion helps prevent the vehicle from getting stuck by hanging up the plow frame in snow, something which is a very common problem in conventional plows. FIG. 8 shows this rear portion in operation as a vehicle ascends an incline. A lifting chain 128 is provided to raise or lower the support member 42.

The snow plow blade 52 may comprise any suitable snow plow blade known in the art. Typically, the snow plow blade 52 will have a curved surface 54 for capturing the snow and channeling it to one side of the vehicle. The snow plow blade may also include a cutting edge 56 made of a hard metallic material. That portion of the snow plow blade forming the curved surface 54 may be formed from any suitable material known in the art having a predetermined set of elastic properties. For example, it can be formed from metal, rubber, plastic, cloth, and combinations thereof.

Figure 7:
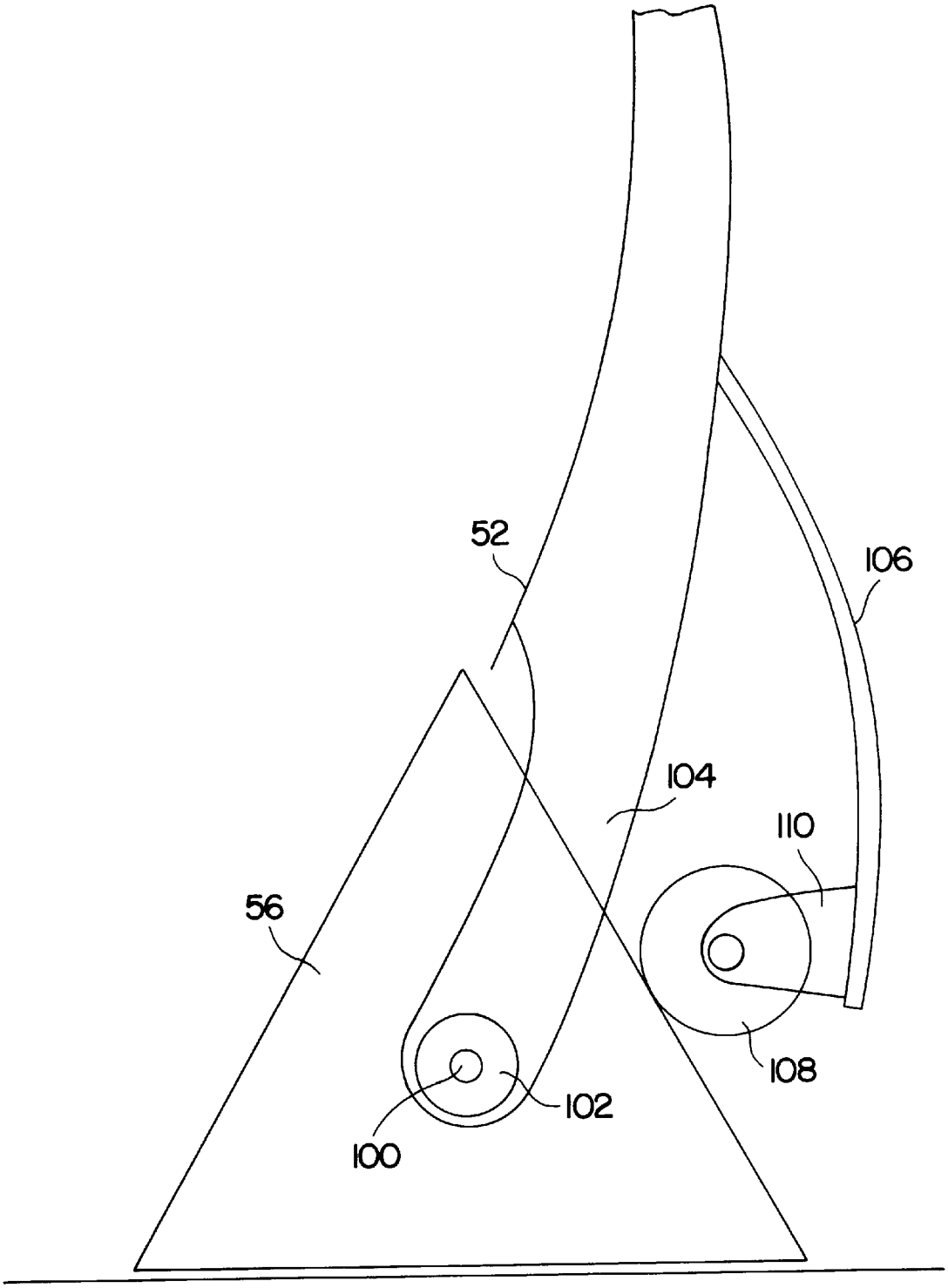
FIG. 7 is an enlarged view of a portion of the snow plow assembly of FIG. 5.

In a preferred embodiment of the present invention, the cutting edge 56 comprises a rolling, triangularly shaped cutting edge. Referring now to FIG. 7, the triangularly shaped cutting edge 56 is preferably provided with a pin 100 at each end. The pin 100 is designed to fit within a bearing assembly 102 in an arm 104 extending downwardly from the snow plow blade. Each arm 104 may be integrally formed with the snow plow blade or attached to a side wall of the snow plow blade in any desired manner known in the art. The snow plow assembly further includes a leaf spring 106 mounted to the rear of the snow plow blade and a roller or wheel 108 attached to the leaf spring as by bracket 110. The spring tensioned wheel 108 acts as a detent positioner which allows the plow blade to roll over solid objects, such as manhole covers. The triangularly shaped cutting edge also provides a cutting edge for backblading or dragging snow backwards. By using such an arrangement to backblade the snow, less shock is transmitted towards the vehicle.

As shown in FIG. 4, the assembly 40 further includes four piston cylinder units 60, 62, 64 and 66, respectively. Two of the piston cylinder units 60 and 62 extend between the front end 50 of the vehicle and mid-span flanges 68 and 70 on opposed sides of the linear support member 42. Each of the piston cylinder units 60 and 62 is mounted to the front end of the vehicle by a hinge mechanism 72 which allows up and down movement as well as rotational or pivotal movement. The hinge mechanism 72 may comprise any suitable hinge mechanism known in the art. Each of the piston-cylinder units 60 and 62 is connected at its second end to one of the flanges 68 and 70 by a hinge or pivot arrangement 74 which allows rotational movement of the linear support element 42 with respect to the piston-cylinder unit(s) 60 and/or 62. Each pivot arrangement 74 could be a bolt or pin having a threaded end connection and a nut for securing the bolt or pin in place, while facilitating disassembly of the snow plow assembly.

The remaining piston cylinder units 64 and 66 extend between the linear support member 42 and the rear of the snow plow blade 52. Each of the piston cylinder units 64 and 66 is connected at one end by a suitable hinge or pivot connection 76 to the flanges 68 and 70 and is connected at its opposite end to a flange 78 on the rear of the snow plow blade by another hinge or pivot connection 80. The hinge or pivot connections 76 and 80 may be formed by any suitable connecting devices known in the art. For example, the hinge connections 76 and 80 may each be bolts or pins having threaded ends for receiving nuts to secure them in position and for permitting easy disassembly of the snow plow assembly 42.

The piston-cylinder units 60, 62, 64 and 66 may be pneumatic or hydraulic units. Further, the piston-cylinder units may be connected via suitable control lines 82 to a pump or motor 83 which is in turn operated by a control box 84 positioned within the cab or passenger compartment of the vehicle. The control box 84 may have multiple levers (not shown) to permit individual or joint operation of the piston cylinder units 60, 62, 64, and 66 so that they move the snow plow blade 52 to a desired angular orientation relative to the central longitudinal axis 46 of the vehicle. For example, the piston cylinder units 60, 62, 64, and 66 may be operated to turn the snow blade left or right depending upon the nature of a turn being made by the vehicle. Preferably, the piston cylinder units 60, 62, 64, and 66 are operated so that the plow is offset from the central longitudinal axis 46 of the vehicle and remains in front of the path of the vehicle's tires.

The assembly 40 further includes deployment means for raising or lowering the snow plow blade 52 relative to the surface being cleaned. The deployment means may comprise the chain 128 or a piston-cylinder unit mounted to the front end 50 of the vehicle and connected to the linear support member 42. The piston-cylinder unit, if used, may be connected in any manner known in the art to a control switch or lever (not shown) positioned within the cab or passenger compartment of the vehicle 48.

In accordance with the present invention, the control system may have three separate joysticks including one for lifting the plow, one for the forward hinge and one for the rearward hinge. The provision of such a system will allow all three motions to be used simultaneously which will save time when the snow plow blade must be repositioned.

If desired, one or more wheels can be provided under and behind the snow plow blade, which wheel(s) can be activated like the landing gear of an airplane so as to lift the plow blade off the ground for road travel, unload the weight of the plow off the vehicle, and reduce damage to the front suspension of the vehicle.

While the assembly of the present invention has been described in the context of a snow plow assembly, it should be recognized that the mounting assembly of the present invention may be used to join other types of plows or blades to a vehicle.

It is apparent that there has been provided in accordance with the present invention a snow plow assembly which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A plow assembly suitable for use with a wheeled vehicle, said assembly comprising:

a linear support member attached to a front of said vehicle;

said linear support member being pivotable with respect to a central longitudinal axis of said vehicle;

a plow blade attached to said linear support member;

means connected to said linear support member for offsetting said plow blade from the central longitudinal axis of said vehicle so that said plow blade is positioned in front of a tire path of and ahead of a direction of travel of said vehicle; and said plow offsetting means comprising a first means for pivoting said linear support member relative to said central longitudinal axis of said vehicle and second means for pivoting said plow relative to said linear support member.

2. The plow assembly of claim 1 wherein said first pivoting means comprises:

a first piston-cylinder unit having one end pivotably attached to said front of said vehicle and a second end pivotably attached to a first side of said linear support member; and a second piston-cylinder unit having one end pivotably attached to said front of said vehicle and a second end pivotably attached to a second side of said linear support member.

3. The plow assembly of claim 2 wherein both said first piston-cylinder unit and said second piston-cylinder unit are attached at said one end to said vehicle by a hinge mechanism which allows up and down movement as well as rotational movement.

4. The plow assembly of claim 2 wherein said linear support member has flanges located in a mid-span region and said first piston-cylinder unit and said second piston-cylinder unit are attached to said flanges.

5. The plow assembly of claim 2 wherein said second pivoting means comprises:

a third piston-cylinder unit pivotably connected at one end to said first side of said linear support member and at a second end to said plow; and a fourth piston-cylinder unit pivotably connected at one end to said second side of said linear support member and at a second end to said plow.

6. The plow assembly of claim 5 further comprising said linear support member having flanges in a mid-span region and said third piston-cylinder unit and said fourth piston-cylinder unit being pivotably connected to said flanges.

7. The plow assembly of claim 5 further comprising said linear support member having a first flange on a first side and a second flange on a second side and said first and third piston-cylinder units being pivotally connected to said first flange and said second and fourth piston-cylinder units being pivotally connected to said second flange.

8. The plow assembly of claim 5 further comprising:

means for operating said piston-cylinder units so that said plow is offset from the central longitudinal axis of said vehicle and positioned in front of the tire path of said vehicle.

9. The plow assembly of claim 8 wherein said operating means includes a control box within a passenger compartment in said vehicle for controlling said piston-cylinder units.

10. The plow assembly of claim 5 further comprising:

a frame member attached to said vehicle;

said linear support member being connected to the frame member by a hinge which allows upward and downward movement of said linear support member;

deployment means for causing said plow to be raised up out of contact with a surface and for causing said plow to be lowered into contact with said surface;

said deployment means being connected to said linear support member.

11. The plow assembly of claim 1 wherein said plow blade comprises a snow plow blade.

12. The plow assembly of claim 1 further comprising:

a triangularly shaped cutting edge; and means for attaching said triangularly shaped cutting edge to said plow blade.

13. The plow assembly of claim 1 further comprising:

said linear support member having a bow-like rear position.

14. A plow assembly suitable for use with a wheeled vehicle, said assembly comprising:

a linear support member attached to a front of said vehicle;

said linear support member being pivotable with respect to a central longitudinal axis of said vehicle;

a plow blade attached to said linear support member;

means connected to said linear support member for offsetting said plow blade from the central longitudinal axis of said vehicle so that said plow blade is positioned in front of a tire path of and ahead of a direction of travel of said vehicle;

a triangularly shaped cutting edge;

means for attaching said triangularly shaped cutting edge to said plow blade;

a leaf spring attached to said blade; and a roller attached to said leaf spring, said roller contacting said triangularly shaped cutting edge so as to allow the plow blade to roll over solid objects.

* * * * *